US010753137B2

(12) United States Patent
Muramatsu et al.

(10) Patent No.: US 10,753,137 B2
(45) Date of Patent: Aug. 25, 2020

(54) WINDOW REGULATOR

(71) Applicant: SHIROKI CORPORATION, Fujisawa-shi, Kanagawa (JP)

(72) Inventors: Atsushi Muramatsu, Fujisawa (JP); Kenji Yamamoto, Fujisawa (JP); Yoshiki Sugita, Fujisawa (JP)

(73) Assignee: SHIROKI CORPORATION, Fujisawa-Shi, Kanagawa (JP)

( * ) Notice: Subject to any disclaimer, the term of this patent is extended or adjusted under 35 U.S.C. 154(b) by 141 days.

(21) Appl. No.: 16/082,450

(22) PCT Filed: Mar. 21, 2017

(86) PCT No.: PCT/JP2017/011219
§ 371 (c)(1),
(2) Date: Sep. 5, 2018

(87) PCT Pub. No.: WO2017/195467
PCT Pub. Date: Nov. 16, 2017

(65) Prior Publication Data

US 2019/0100953 A1 Apr. 4, 2019

(30) Foreign Application Priority Data

May 12, 2016 (JP) ..... 2016-096215

(51) Int. Cl.
*E05F 11/48* (2006.01)
*E05F 15/689* (2015.01)
*E05F 11/38* (2006.01)

(52) U.S. Cl.
CPC ..... *E05F 11/481* (2013.01); *E05F 11/382* (2013.01); *E05F 11/488* (2013.01);
(Continued)

(58) Field of Classification Search
None
See application file for complete search history.

(56) References Cited

U.S. PATENT DOCUMENTS 2,379,923 A * 7/1945 Roethel ..... E05F 11/405 49/375
4,347,755 A * 9/1982 Becker ..... E05F 15/689 49/350

(Continued)

FOREIGN PATENT DOCUMENTS

JP S58-064777 U 5/1983
JP S58-181885 U 12/1983
JP H08-004411 A 1/1996

OTHER PUBLICATIONS

International Search Report (PCT/ISA/210) dated Jun. 27, 2017, by the Japanese Patent Office as the International Searching Authority for International Application No. PCT/JP2017/011219.

(Continued)

*Primary Examiner* — Catherine A Kelly
(74) *Attorney, Agent, or Firm* — Buchanan Ingersoll & Rooney PC

(57) ABSTRACT

A window regulator includes a guide rail fixed to a vehicle door panel and a slider base that supports a window glass and is slidably supported in a longitudinal direction of the guide rail along sliding surfaces on a front and a back of the guide rail. The guide rail includes a sliding portion that has a first sliding surface and a second sliding surface that face one direction and another direction in a vehicle inner-outer direction. The slider base includes a grease injection portion that includes an injection space and a grease receiving portion. The injection space opens to the vehicle inner-outer direction. The first sliding surface of the guide rail is positioned inside the injection space. The grease receiving portion is positioned opposed to the second sliding surface of the guide rail. The grease receiving portion receives a grease injected in the injection space.

7 Claims, 11 Drawing Sheets

(52) U.S. Cl.
CPC ..... *E05F 15/689* (2015.01); *E05Y 2201/612* (2013.01); *E05Y 2201/658* (2013.01); *E05Y 2201/684* (2013.01); *E05Y 2800/412* (2013.01); *E05Y 2900/55* (2013.01)

(56) References Cited

U.S. PATENT DOCUMENTS 6,401,867 B1 * 6/2002 Michioka ..... B23Q 1/58 184/5
7,690,155 B2 * 4/2010 Isomura ..... E05F 11/481 49/352
8,726,573 B2 * 5/2014 Katayama ..... E05F 11/445 49/26
8,943,665 B2 * 2/2015 Walawender ..... E05D 15/165 29/458
9,682,389 B2 * 6/2017 Lee ..... B05B 9/01
10,208,529 B2 * 2/2019 Betker ..... E06B 1/522
2004/0111970 A1 * 6/2004 Fenelon ..... E05F 11/385 49/349
2008/0155901 A1 * 7/2008 Rietdijk ..... E05F 11/423 49/349
2011/0067311 A1 * 3/2011 Corden ..... E05F 11/382 49/70
2013/0111816 A1 * 5/2013 Kinoshita ..... E05F 11/486 49/376
2016/0362929 A1 * 12/2016 Schweiss ..... E06B 3/38
2019/0040668 A1 * 2/2019 Muramatsu ..... E05F 11/48
2019/0048641 A1 * 2/2019 Muramatsu ..... F16H 57/045
2020/0071981 A1 * 3/2020 Beadle ..... C10M 103/02
2020/0131823 A1 * 4/2020 Yamamoto ..... E05F 11/483
2020/0131833 A1 * 4/2020 Yamamoto ..... E05F 11/382
2020/0131834 A1 * 4/2020 Yamamoto ..... B60J 1/17

OTHER PUBLICATIONS

Written Opinion (PCT/ISA/237) dated Jun. 27, 2017, by the Japanese Patent Office as the International Searching Authority for International Application No. PCT/JP2017/011219.

* cited by examiner

WINDOW REGULATOR

TECHNICAL FIELD

The present invention relates to a window regulator that moves up and down a window glass of a vehicle.

BACKGROUND ART

A window regulator for a vehicle where a slider base (glass carrier) to which a window glass is fixed is movably supported in a longitudinal direction of a guide rail and the slider base is slid with respect to the guide rail by being pulled with a wire to perform an up-down operation of the window glass has been widely used. In the window regulator of this type, grease is applied over a sliding contact part of the guide rail with the slider base for smooth sliding of the slider base with respect to the guide rail.

Patent Literature 1 has proposed the following window regulator. The window regulator includes a closed space configured to house grease and a through-hole that communicates between this closed space and the outside at the slider base. The slider base is slid with the grease injected from the through-hole to the inside of the closed space to apply the grease over a sliding surface of the guide rail. This configuration allows eliminating a labor to directly apply the grease along the sliding surface of the guide rail as an elongated member.

CITATION LIST

Patent Literature

Patent Literature 1: Japanese Unexamined Patent Application Publication No. H8-4411

SUMMARY OF THE INVENTION

Problems to be Solved by the Invention

The window regulator of Patent Literature 1 has a guide rail that is formed as U-shaped cross-sectional shape in which a side of the guide rail facing the slider base is open. The slider base includes a plate-shaped portion facing the open side of the guide rail and a pair of shoes projecting from the plate-shaped portion and slidably inserted into the guide rail. A space surrounded by the plate-shaped portion of the slider base, the pair of shoes, and the inner surfaces of the guide rail is the above-described closed space. The above-described through-hole is formed at the plate-shaped portion of the slider base. All sliding surfaces (surfaces with which the shoes of the slider base are in slidable contact) of the guide rail are surfaces facing the inside of the guide rail having the U shape in the cross section. Therefore, only by simply injecting the grease to the inside of the closed space through the through-hole of the slider base allows the grease to be applied over all sliding surfaces of the guide rail.

However, with a window regulator of a type having sliding surfaces at a front and a back of a plate-shaped guide rail where a slider base is configured to be in slidable contact with these front and back sliding surfaces, even when a through-hole is formed on the slider base like Patent Literature 1, there is a problem that only simply injecting grease from the through-hole fails to apply the grease over the sliding surface on a side (back side) opposite to the side facing the through-hole in the guide rail. Therefore, separately from the grease injection from the through-hole, a process of applying the grease over the sliding surface on the back side of the guide rail is required, resulting in an increase in man-hour and a complicated device for grease application.

The present invention has been made in consideration of the above-described problems and an object of the present invention is to provide a window regulator configured to easily and surely supply grease to sliding parts of sliding contact surfaces on a front and a back of a guide rail with a slider base.

Solutions to the Problems

The present invention is a window regulator that includes a guide rail and a slider base. The guide rail is fixed to a vehicle door panel. The slider base supports a window glass. The slider base is slidably supported in a longitudinal direction of the guide rail. The guide rail includes a sliding portion along which the slider base is slidable. The sliding portion has a first sliding surface and a second sliding surface that face one direction and another direction in a vehicle inner-outer direction. The slider base includes a grease injection portion. The grease injection portion includes an injection space and a grease receiving portion. The injection space opens to the vehicle inner-outer direction. The first sliding surface of the guide rail is positioned inside the injection space. The grease receiving portion is positioned opposed to the second sliding surface of the guide rail. The grease receiving portion receives grease injected in the injection space. The grease injection portion with this configuration allows easily and surely supplying the grease to both of the first sliding surface and the second sliding surface of the guide rail.

The grease receiving portion is preferably an elastically deformable projection projecting from an inner surface of the injection space.

The grease receiving portion preferably has an inclined shape extending in a direction away from the second sliding surface in the vehicle inner-outer direction as the grease receiving portion advances from a base end connected to the inner surface of the injection space to a distal end side.

The guide rail has an edge facing a vehicle front-rear direction between the first sliding surface and the second sliding surface. The edge is positioned inside the injection space to facilitate flowing the grease through a space on the first sliding surface side and a space on the second sliding surface side.

The following configuration is preferable. The slider base includes a pair of guide portions on different positions in the longitudinal direction of the guide rail. The pair of guide portions are slidable with respect to the first sliding surface and the second sliding surface. The grease injection portion is positioned between the pair of guide portions in the longitudinal direction of the guide rail. This configuration allows the grease injected to the grease injection portion to be efficiently applied over the guide rail by the respective guide portions. The extra grease is less likely to remain outside a sliding range of the guide rail at which the slider base slides with respect to the guide rail.

The injection space may internally include a vibration suppressing portion. The vibration suppressing portion is slidable with respect to the first sliding surface.

Furthermore, a pair of vibration suppressing portions are disposed on different positions in the longitudinal direction of the guide rail inside the injection space. The grease receiving portion is configured to be positioned between these pair of vibration suppressing portions. This facilitates guiding the grease to the second sliding surface side.

Advantageous Effects of the Invention

According to the above-described present invention, a slider base includes a grease injection portion that has a configuration of allowing grease to be guided to both of a first sliding surface and a second sliding surface of a guide rail by an injection of the grease to an injection opening. This achieves easily and surely supplying the grease to a sliding part of the guide rail along which a slider base is slidable in a window regulator.

DESCRIPTION OF PREFERRED EMBODIMENTS

Figure 1:
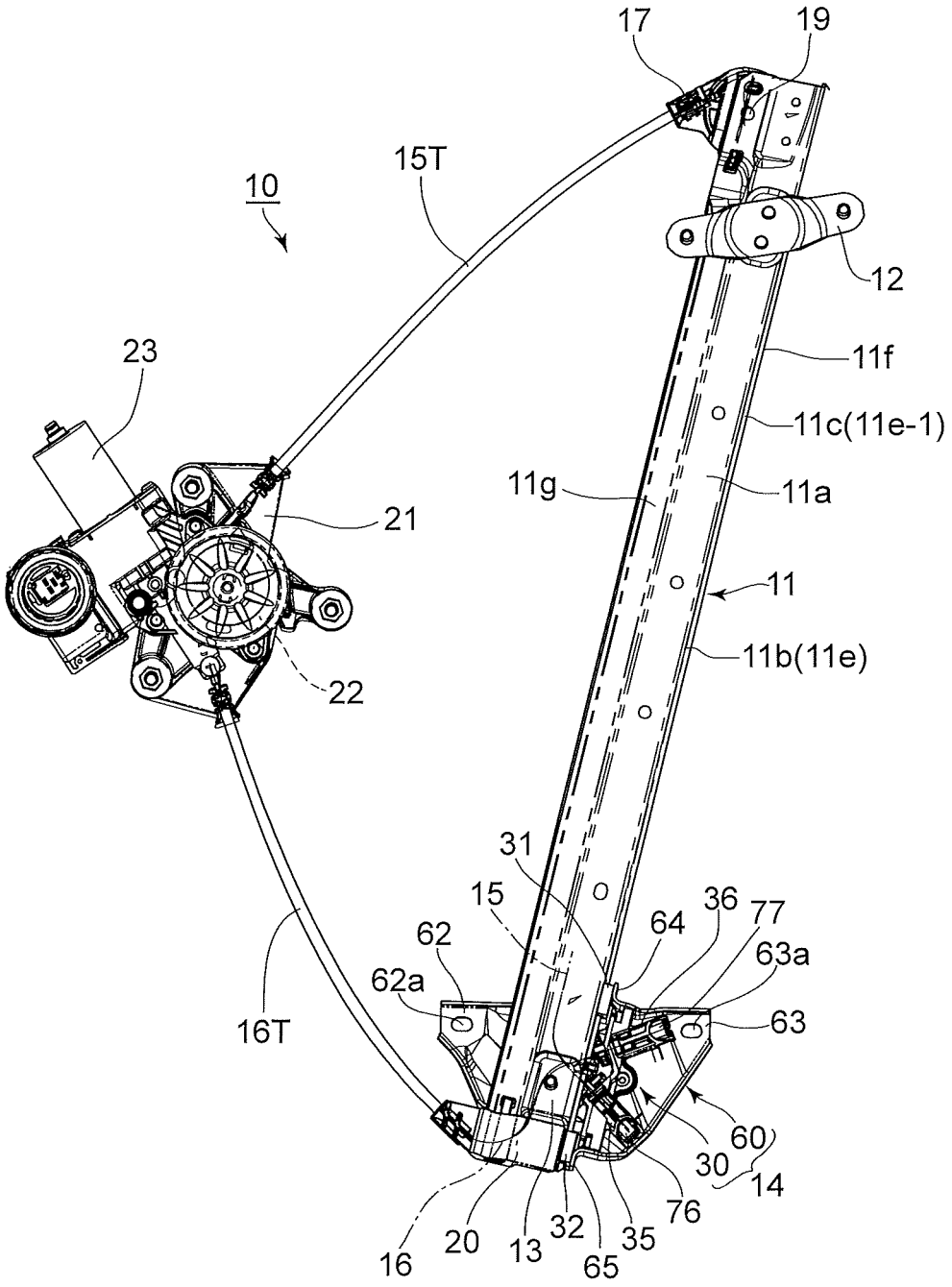
FIG. 1 is a drawing viewing a window regulator to which the present invention is applied from a vehicle inner side.
Figure 2:
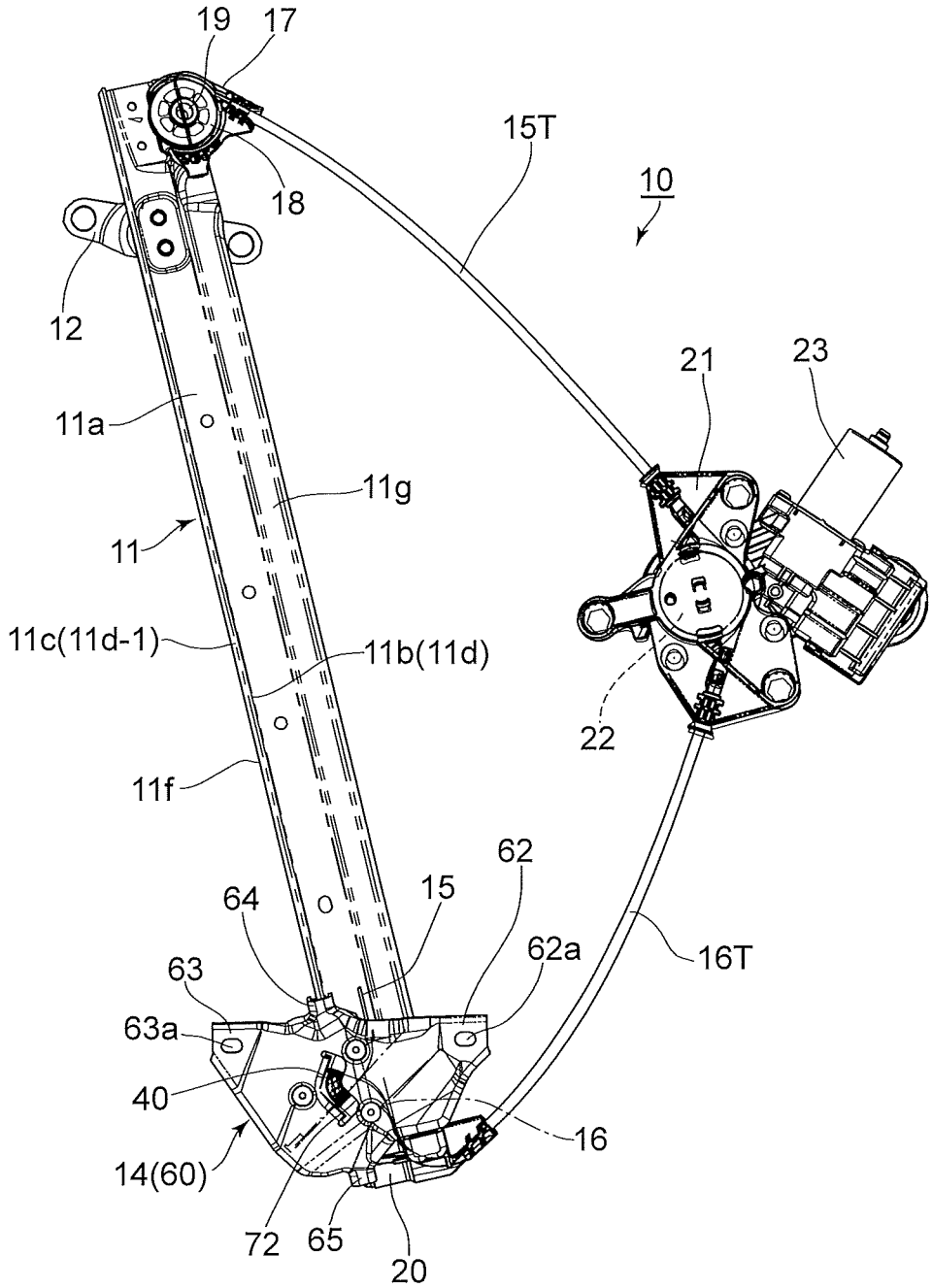
FIG. 2 is a drawing viewing the window regulator from a vehicle outer side.

A window regulator 10 illustrated in FIG. 1 and FIG. 2 includes a guide rail 11 as an elongated member. The guide rail 11 is mounted to an inside of a door panel (inner panel, not illustrated) of a vehicle via brackets 12 and 13 disposed on different positions in a longitudinal direction. The guide rail 11 is arranged having the longitudinal direction in an almost up-down direction (height direction) of the vehicle in a state of being mounted to the door panel of the vehicle. The door panel to which the window regulator 10 is mounted is a side door of the vehicle. In a completed state of the vehicle, the right-left direction in FIG. 1 and FIG. 2 becomes a vehicle front-rear direction.

The window regulator 10 includes a slider base (glass carrier) 14 that is supported along the guide rail 11 so as to freely move up and down in the vehicle up-down direction and to which a window glass (not illustrated) is supported. Respective one ends of a pair of drive wires 15 and 16 are coupled to the slider base 14.

A pulley bracket 17 is fixed adjacent to an upper end in the longitudinal direction of the guide rail 11, and a guide pulley 18 is rotatably supported to the pulley bracket 17 via a pulley support shaft 19. The drive wire 15 extends from the slider base 14 in an upward direction of the guide rail 11 along the guide rail 11, and is supported by a wire guide groove formed on an outer peripheral surface of the guide pulley 18. Corresponding to advance and retreat of the drive wire 15, the guide pulley 18 rotates around the pulley support shaft 19.

A wire guide member 20 is disposed adjacent to a lower end in the longitudinal direction of the guide rail 11. The drive wire 16 extends from the slider base 14 in a downward direction of the guide rail 11 along the guide rail 11, and is guided by the wire guide member 20. The wire guide member 20 is fixed to the guide rail 11, and the drive wire 16 is supported such that the drive wire 16 is configured to advance and retreat along a wire guide groove formed on the wire guide member 20.

The drive wire 15 coming out from the guide pulley 18 is inserted into a tubular outer tube 15T and wound around a drive drum 22 disposed inside a drum housing 21 to which the outer tube 15T is coupled. The drive wire 16 coming out from the wire guide member 20 is inserted into a tubular outer tube 16T and wound around the drive drum 22 disposed inside the drum housing 21 to which the outer tube 16T is coupled. A spiral groove around which the drive wire 15 and the drive wire 16 are wound is formed on the outer peripheral surface of the drive drum 22. The drive drum 22 is rotatably driven by a motor 23.

The drum housing 21 is fixed to the door panel (inner panel). When the driving force of the motor 23 positively/reversely rotates the drive drum 22, one of the drive wire 15 and the drive wire 16 increases a winding amount around the spiral groove of the drive drum 22, and the other is drawn out from the spiral groove of the drive drum 22, thus causing the slider base 14 to move along the guide rail 11 due to a relationship of pulling and loosening between the drive wire 15 and the drive wire 16. Corresponding to the move of the slider base 14, the window glass moves up and down.

The following describes structures of the guide rail 11 and the slider base 14 in detail. FIG. 4, FIG. 6, FIG. 7, FIG. 9, and FIG. 10 indicate directions of a vehicle outer side and a vehicle inner side in a state where the window regulator 10 is mounted to the door of the vehicle by arrows, and a direction connecting these vehicle outer side and vehicle inner side is defined as a vehicle inner-outer direction.

Figure 4:
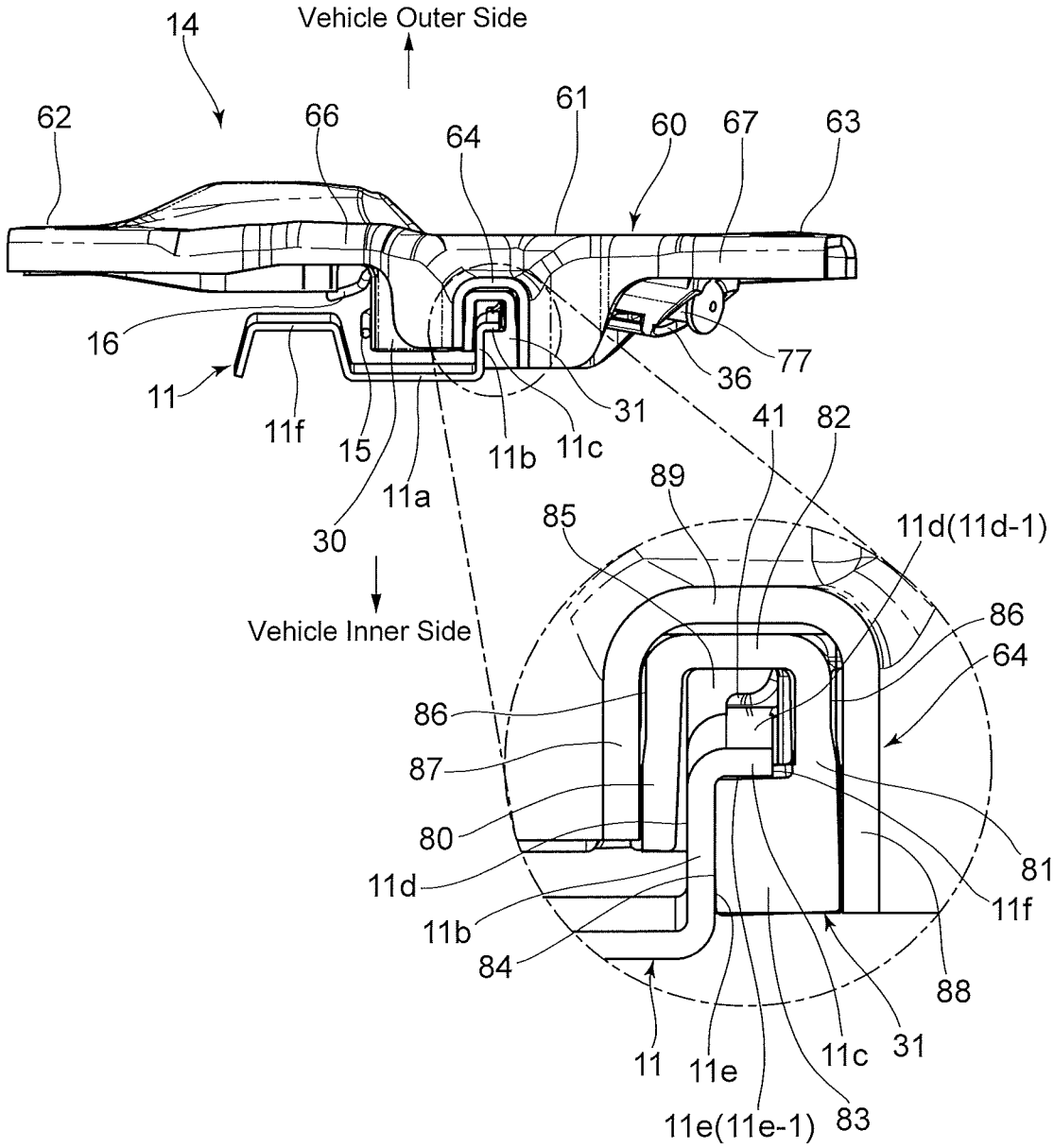
FIG. 4 is a drawing viewed from the arrow IV of FIG. 3.
Figure 6:
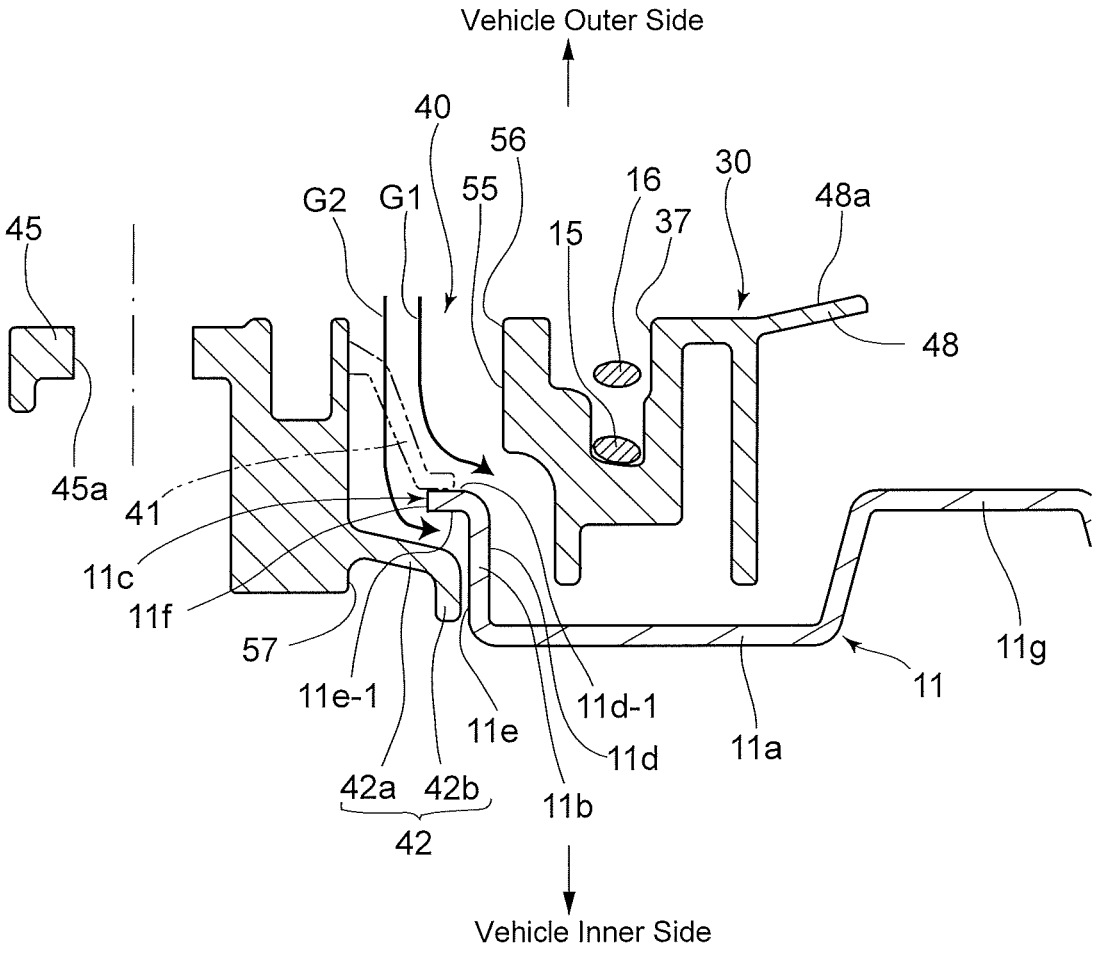
FIG. 6 is a cross-sectional view taken along the line VI-VI of FIG. 5.
Figure 9:
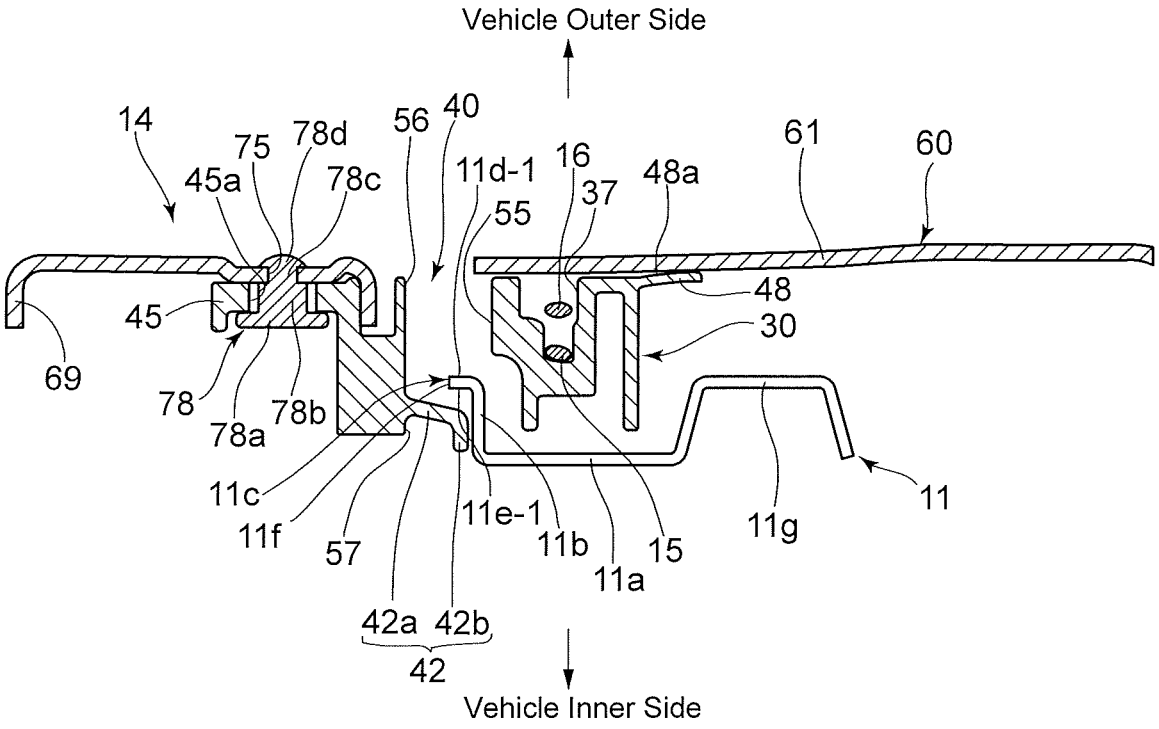
FIG. 9 is a cross-sectional view taken along the line IX-IX of FIG. 8.

As illustrated in FIG. 4, FIG. 6 and FIG. 9, the guide rail 11 includes a sidewall lib. The sidewall lib, which projects toward the vehicle outer side (extends in the vehicle-width direction), is disposed at one side portion of a plate-shaped portion 11*a* having surfaces facing the vehicle inner side and the vehicle outer side. A support flange 11*c* laterally projects from the sidewall lib. A sliding surface 11*d* and a sliding surface 11*e* are formed at the front and the back of the sidewall 11*b* and the support flange 11*c*. The sliding surface 11*d* at the support flange 11*c* is defined as a first sliding surface 11*d*-1, and the sliding surface 11*e* at the support flange 11*c* is defined as a second sliding surface 11*e*-1 (see FIG. 4 and FIG. 6). The first sliding surface 11*d*-1 is a surface facing the vehicle outer side, and the sliding surface 11*e* is a surface facing the vehicle inner side. The support flange 11*c* further has an edge surface 11*f* between the first sliding surface 11*d*-1 and the second sliding surface 11*e*-1. The edge surface 11*f* is positioned at one edge in the vehicle front-rear direction. The edge surface 11*f* faces the front or the rear of the vehicle with the guide rail 11 mounted to the door panel. The guide rail 11 further has a projecting portion 11*g* with a squared U shape in the cross section, which projects to the vehicle outer side with respect to the plate-shaped portion 11*a*, at a side portion on a side opposite to a side where the sidewall 11*b* and the support flange 11*c* are disposed.

Figure 5:
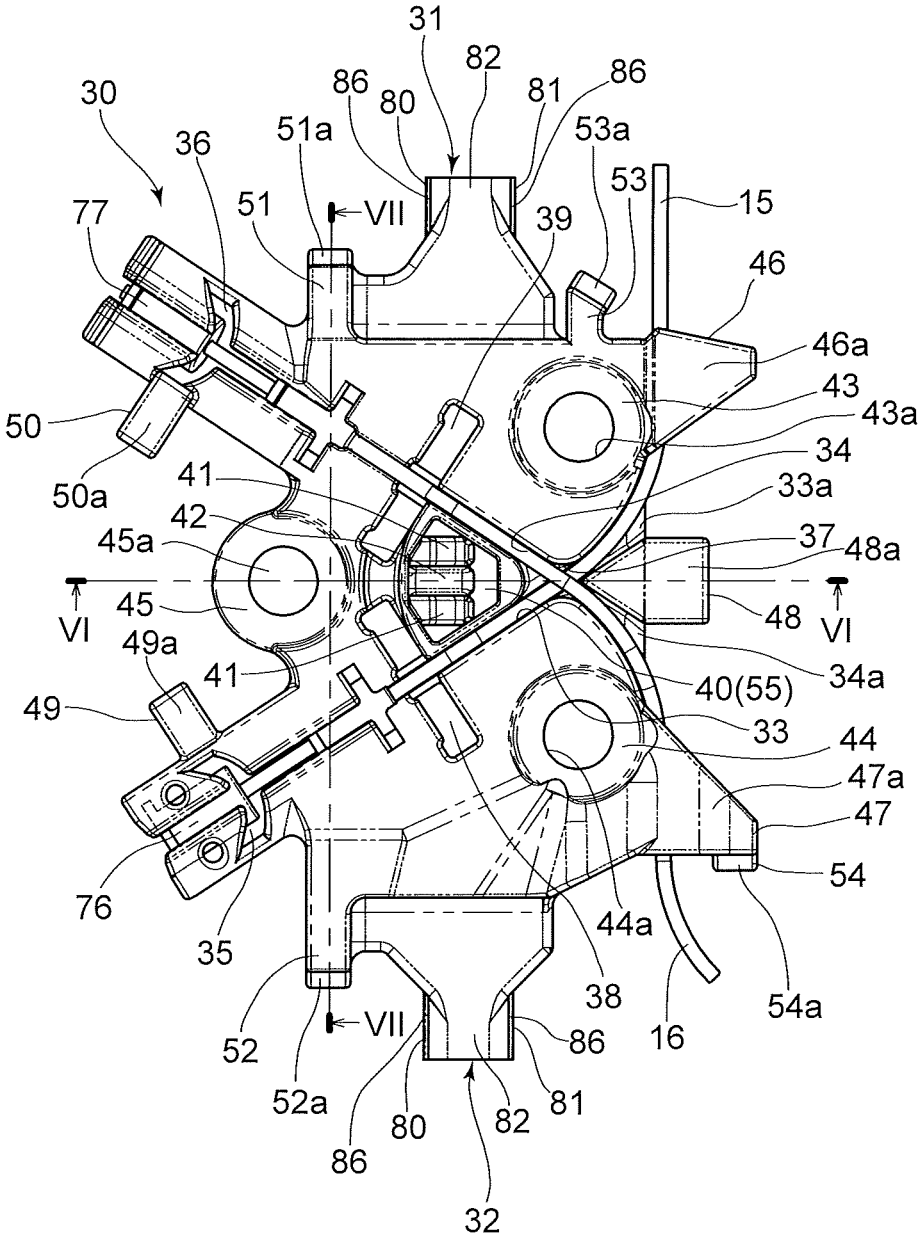
FIG. 5 is a drawing viewing a sliding member constituting the slider base from the vehicle inner side.

The slider base 14 is constituted by combining a sliding member 30 made of synthetic resin and a metallic holder member 60. FIG. 5 illustrates the sliding member 30 alone.

Figure 11:
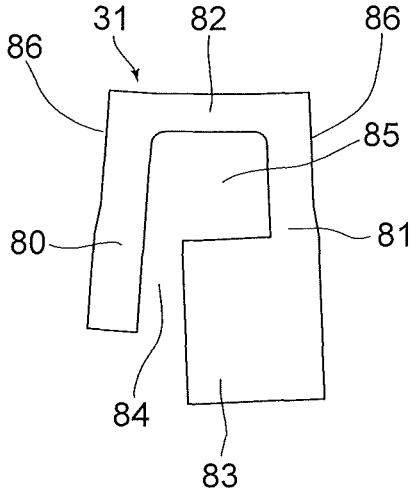
FIG. 11 is a drawing illustrating a free state of a guide shoe of the sliding member.

First, the following describes the configuration of the sliding member 30. As illustrated in FIG. 5, the sliding member 30 includes a guide shoe 31 (guide portion) at the upper end in the vehicle up-down direction of the slider base 14 and a guide shoe 32 (guide portion) at the lower end. As illustrated in FIG. 4 and FIG. 11, the guide shoe 31 includes a sidewall 80 and a sidewall 81, which separate in the vehicle front-rear direction, a bottom wall 82, which connects the sidewall 80 and the sidewall 81, and a convex portion 83, which has a shape of projecting a part of the sidewall 81 to the sidewall 80 side. A thin groove portion 84 is formed between the sidewall 80 and the convex portion 83, and a wide width groove portion 85 having a width wider than that of the thin groove portion 84 is formed between the sidewall 80 and the sidewall 81. Narrowing portions 86 that partially narrow down the width of the guide shoe 31 are formed on both sides of the sidewall 80 and the sidewall 81. The narrowing portions 86 are formed at a part of regions close to the bottom wall 82 in the sidewall 80 and the sidewall 81. The guide shoe 31 is elastically deformable and especially easily deforms elastically in the vehicle front-rear direction in which an interval between the sidewall 80 and the sidewall 81 (convex portion 83) is changed. FIG. 11 illustrates the guide shoe 31 in a free state. The guide shoe 31 in the free state has a shape of expanding the interval between the sidewall 80 and the sidewall 81 as the guide shoe 31 is away from the bottom wall 82. While the illustration of the detailed structure of the guide shoe 32 is omitted, the guide shoe 32 has a configuration similar to the guide shoe 31 and is elastically deformable. Reference numerals common to the guide shoe 31 are assigned for parts of the guide shoe 32 common to those of the guide shoe 31.

As illustrated in FIG. 5, the sliding member 30 includes a pair of wire guide grooves 33 and 34 positioned between the guide shoe 31 and the guide shoe 32 in the vehicle up-down direction. The wire guide grooves 33 and 34 have wire introduction ports 33*a* and 34*a*, which are open to one side portion of the sliding member 30, respectively. Wire end housing portions 35 and 36 are formed at the other side portion of the sliding member 30. The wire guide groove 33 is a groove portion that communicates between the wire introduction port 33*a* and the wire end housing portion 35. The wire introduction port 33*a* is positioned upward with respect to the wire end housing portion 35. The wire guide groove 33 extends obliquely downward from the wire introduction port 33*a* to the wire end housing portion 35. The wire guide groove 34 is a groove portion that communicates between the wire introduction port 34*a* and the wire end housing portion 36. The wire introduction port 34*a* is positioned downward with respect to the wire end housing portion 36. The wire guide groove 34 extends obliquely upward from the wire introduction port 34*a* to the wire end housing portion 36. The wire guide groove 33 intersects with the wire guide groove 34 at an intersecting portion 37 near the wire introduction port 33*a* and the wire introduction port 34*a*.

The wire end housing portions 35 and 36 are depressed portions each having a width wider than the groove widths of the wire guide grooves 33 and 34. The wire end housing portion 35 is positioned on an extension of the wire guide groove 33 and projects obliquely downward from the side portion of the sliding member 30. The wire end housing portion 36 is positioned on an extension of the wire guide groove 34 and projects obliquely upward from the side portion of the sliding member 30. An insertion groove 38 intersecting with the wire guide groove 33 and an insertion groove 39 intersecting with the wire guide groove 34 are formed on the sliding member 30.

As illustrated in FIG. 5 and FIG. 6, a grease injection portion 40 is formed at a sector form region, which is surrounded by the wire guide grooves 33 and 34 and the insertion grooves 38 and 39 and having the apex at the intersecting portion 37, of the sliding member 30. The grease injection portion 40 has an injection space 55 that penetrates the sliding member 30 in the vehicle inner-outer direction. The injection space 55 has an opening 56 on the vehicle outer side and an opening 57 on the vehicle inner side. The injection space 55 internally has a pair of vibration suppressing projections 41 (vibration suppressing portions) and a grease receiving projection 42 (grease receiving portion).

The pair of vibration suppressing projections 41 are disposed on different positions in the vehicle up-down direction. As illustrated in FIG. 6, the vibration suppressing projections 41 are cantilevered projections whose base ends are connected to positions close to the opening 56, which is on the vehicle outer side, in the inner surface of the injection space 55 and have an inclined shape heading for the vehicle inner side as away from these base ends and advancing to the distal end side. The vibration suppressing projections 41 are elastically deformable in the vehicle inner-outer direction with the base ends as fulcrums.

The grease receiving projection 42 is positioned between the pair of vibration suppressing projections 41 in the vehicle up-down direction. As illustrated in FIG. 6, the grease receiving projection 42 is a cantilevered projection whose base end is connected to a position close to the opening 57, which is on the vehicle inner side, in the inner surface of the injection space 55. The grease receiving projection 42 has an inclined portion 42*a* and a distal end bended portion 42*b*. The inclined portion 42*a* heads for the vehicle inner side as away from the base end and advancing to the distal end side. The distal end bended portion 42*b* is formed by bending the distal end of the inclined portion 42*a* to the vehicle inner side. The vibration suppressing projections 41 are elastically deformable in the vehicle inner-outer direction with the base end of the inclined portion 42*b* as fulcrum.

As illustrated in FIG. 5, the sliding member 30 includes a fastening seat 43 and a fastening seat 44 between which the intersecting portion 37 is interposed on both sides in the vehicle up-down direction of the intersecting portion 37, and a fastening seat 45 at a side portion (a side portion on the side opposite to the grease injection portion 40) of the insertion groove 38 and the insertion groove 39. Insertion holes 43*a*, 44*a*, and 45*a* penetrating in the vehicle inner-outer direction are formed at the fastening seats 43, 44, and 45, respectively.

The sliding member 30 further includes two fixation support portions 46 and 47, seven elastic support portions 48, 49, 50, 51, 52, 53, and 54. The fixation support portion 46 is positioned at the side portion of the fastening seat 43, the fixation support portion 47 is positioned at the side portion of the fastening seat 44, and the fixation support portion 46 and the fixation support portion 47 have support surfaces 46*a* and 47*a* facing the vehicle outer side, respectively. The elastic support portions 48, 49, 50, 51, 52, 53, and 54 are each elastically deformable part in respective directions described later. The fixation support portions 46 and 47 are parts with a constant shape that are less likely to cause elastic deformation compared with the elastic support portions 48 49, 50, 51, 52, 53, and 54.

As illustrated in FIG. 5, the elastic support portion 48 is positioned at the side portion of the intersecting portion 37 and is positioned between the fixation support portion 46 and the fixation support portion 47 in the vehicle up-down direction. As illustrated in FIG. 6, the elastic support portion 48 is a cantilevered projecting piece whose base end is connected to a surface on the vehicle outer side of the sliding member 30, has an abutting surface 48*a* facing the vehicle outer side, and is elastically deformable in the vehicle inner-outer direction. FIG. 6 illustrates the elastic support portion 48 in the free state, and the elastic support portion 48 in the free state increases an amount of projection to the vehicle outer side as heading from the base end to the distal end side.

As illustrated in FIG. 5, the elastic support portion 49 is a cantilevered projecting piece projecting obliquely upward from the wire end housing portion 35 and has an abutting surface 49*a* facing the vehicle outer side. The elastic support portion 50 is a cantilevered projecting piece projecting obliquely downward from the wire end housing portion 36 and has an abutting surface 50*a* facing the vehicle outer side. Similar to the elastic support portion 48, the elastic support portions 49 and 50 are each elastically deformable in the vehicle inner-outer direction. The elastic support portions 49 and 50 in the free state increase the amount of projection to the vehicle outer side as heading from the base end to the distal end side.

Figure 7:
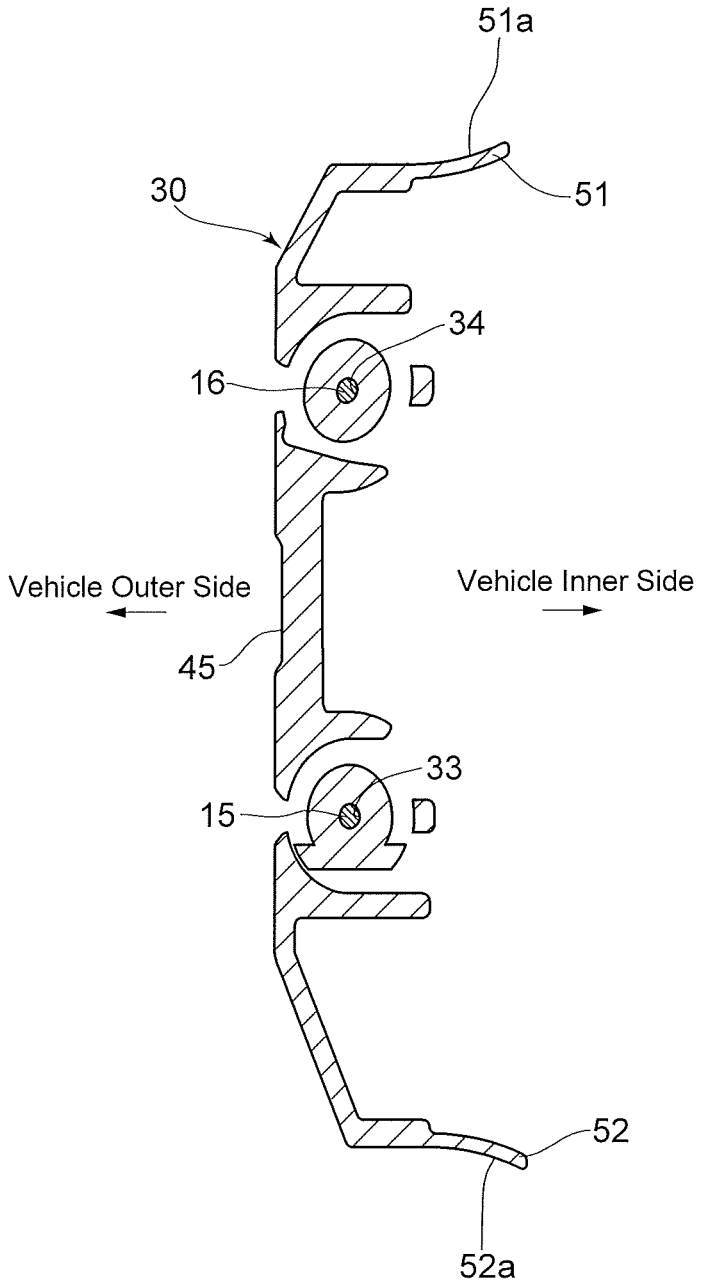
FIG. 7 is a cross-sectional view taken along the line VII-VII of FIG. 5.

As illustrated in FIG. 5, the elastic support portion 51 is positioned between the guide shoe 31 and the wire end housing portion 36 in the vehicle front-rear direction, and the elastic support portion 52 is positioned between the guide shoe 32 and the wire end housing portion 35 in the vehicle front-rear direction. As illustrated in FIG. 7, the elastic support portion 51 is a cantilevered projecting piece projecting from the upper edge of the sliding member 30 to the vehicle inner side and has an abutting surface 51*a* facing upward. The elastic support portion 52 is a cantilevered projecting piece projecting from the lower edge of the sliding member 30 to the vehicle inner side and has an abutting surface 52*a* facing downward. The elastic support portions 51 and 52 are each elastically deformable in the vehicle up-down direction. FIG. 5 and FIG. 7 illustrate the elastic support portions 51 and 52 in the free state. The elastic support portion 51 in the free state has a curved shape with increasing amount of projection of the abutting surface 51*a* to the upper side as heading for the distal end side (vehicle inner side). The elastic support portion 52 in the free state has a curved shape with increasing amount of projection of the abutting surface 52*a* to the lower side as heading for the distal end side (vehicle inner side). In other words, the elastic support portions 51 and 52 in the free state gradually widen intervals in the vehicle up-down direction as heading for the distal end side (vehicle inner side).

As illustrated in FIG. 5, the elastic support portion 53 is positioned on a side (upward the fastening seat 43) opposite to the elastic support portion 51 between which the guide shoe 31 is interposed in the vehicle front-rear direction. Similar to the elastic support portion 51, the elastic support portion 53 is a cantilevered projecting piece projecting from the upper edge of the sliding member 30 to the vehicle inner side and has an abutting surface 53*a* facing upward (obliquely upward). The elastic support portion 54 is a cantilevered projecting piece projecting from the lower edge of the fixation support portion 47 to the vehicle inner side and has an abutting surface 54*a* facing downward. The elastic support portions 53 and 54 are each elastically deformable in the vehicle up-down direction, and FIG. 5 illustrates the elastic support portions 53 and 54 in the free state. The elastic support portion 53 in the free state has a curved shape with increasing amount of projection of the abutting surface 53*a* to the upper side as heading for the distal end side (vehicle inner side). The elastic support portion 54 in the free state has a curved shape with increasing amount of projection of the abutting surface 54*a* to the lower side as heading for the distal end side (vehicle inner side). In other words, the elastic support portions 53 and 54 in the free state gradually widen intervals in the vehicle up-down direction as heading for the distal end side (vehicle inner side).

Figure 3:
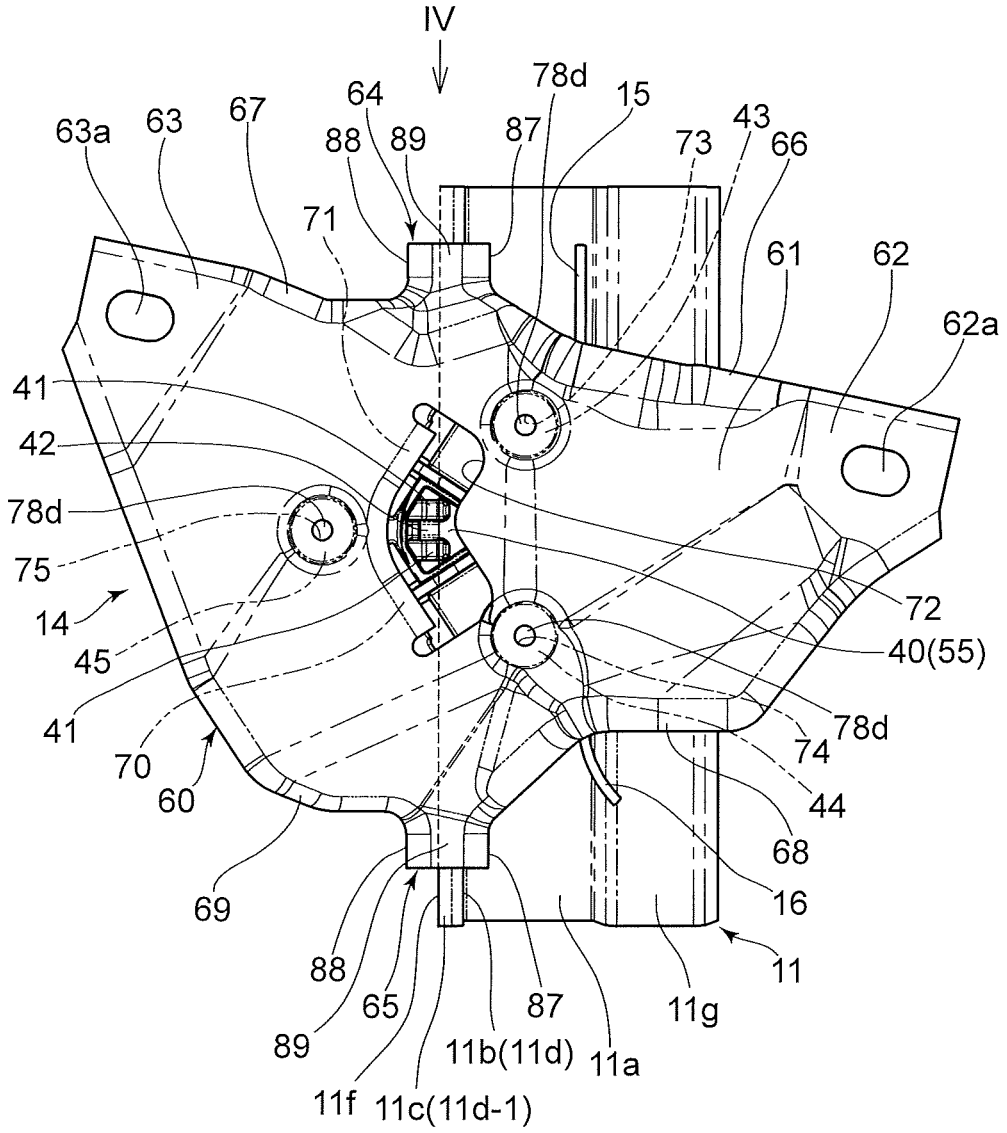
FIG. 3 is a drawing viewing a part of a guide rail and a slider base constituting the window regulator from the vehicle outer side.

Subsequently, the following describes the configuration of the holder member 60. As illustrated in FIG. 3, the holder member 60 includes a plate-shaped cover 61 and glass mounting portions 62 and 63 positioned on both sides of the cover 61. The glass mounting portion 62 and the glass mounting portion 63 have bolt insertion holes 62*a* and 63*a* into which bolts (not illustrated) to fasten and fix the window glass are inserted.

In the vicinity the center in the vehicle front-rear direction of the cover 61, a sandwiching portion 64 is provided on the upper end side, and a sandwiching portion 65 is provided on the lower end side. As illustrated in FIG. 4, the sandwiching portion 64 has a squared U-shape in the cross section and has a pair of sidewalls 87 and 88 separated and opposed in the vehicle front-rear direction and a bottom wall 89 that connects these pair of sidewalls 87 and 88 together, and the vehicle inner side opposite to the bottom wall 89 is open. The sandwiching portion 65 has a configuration similar to that of the sandwiching portion 64; therefore, reference numerals common to the sandwiching portion 64 are assigned for parts of the sandwiching portion 65 common to those of the sandwiching portion 64.

The holder member 60 includes a flange 66 and a flange 67 on the upper edge. The flange 66 is continuous with the sidewall 87 of the sandwiching portion 64 and extends up to the glass mounting portion 62. The flange 67 is continuous with the sidewall 88 of the sandwiching portion 64 and extends up to the glass mounting portion 63. The holder member 60 includes a flange 68 and a flange 69 on the lower edge. The flange 68 is continuous with the sidewall 87 of the sandwiching portion 65 and extends up to the glass mounting portion 62. The flange 69 is continuous with the sidewall 88 of the sandwiching portion 65 and extends up to the glass mounting portion 63. All of the flanges 66, 67, 68, and 69 have a shape formed by bending the peripheral edges of the cover 61 to the vehicle inner side (see FIG. 10).

An insertion piece 70 and an insertion piece 71 paired and disposed on different positions in the vehicle up-down direction are formed near the center of the cover 61. The insertion piece 70 and the insertion piece 71 are forked projecting portions formed by cutting and raising a part of the cover 61 to the vehicle inner side and have groove portions at the distal ends. The cover 61 has a through-hole 72 formed by cutting and raising when the insertion piece 70 and the insertion piece 71 are formed.

The cover 61 further has three fastening holes 73, 74, and 75 at positions surrounding the through-hole 72. The fastening holes 73, 74, and 75 are disposed with a positional relationship corresponding to the insertion holes 43*a*, 44*a*, and 45*a* of the sliding member 30.

Before assembling the sliding member 30 and the holder member 60, the drive wire 15 and the drive wire 16 are installed to the sliding member 30. As illustrated in FIG. 5, a wire end 76 having a diameter larger than that of the drive wire 15 is disposed at the end of the drive wire 15. The wire end 76 is inserted into the wire end housing portion 35, and the drive wire 15 is inserted into the wire guide groove 33. A wire end 77 having a diameter larger than that of the drive wire 16 is disposed at the end of the drive wire 16. The wire end 77 is inserted into the wire end housing portion 36, and the drive wire 16 is inserted into the wire guide groove 34. Into the respective wire end housing portion 35 and wire end housing portion 36, springs (not illustrated) to bias the wire end 76 and the wire end 77 in a pulling direction (direction opposite to the wire guide grooves 33 and 34) are inserted. The drive wire 15 inserted into the wire guide groove 33 and the drive wire 16 inserted into the wire guide groove 34 each pass through the intersecting portion 37 and are pulled out to the outside of the sliding member 30 through the wire introduction port 33*a* and the wire introduction port 34*a*, respectively. As illustrated in FIG. 6 and FIG. 9, the drive wire 15 and the drive wire 16 are routed so as to be different positions in the vehicle inner-outer direction at the intersecting portion 37; therefore, the drive wire 15 and the drive wire 16 do not interfere with one another.

As illustrated in FIG. 5, the fixation support portion 46 of the sliding member 30 has a shape projecting to the side portion of the sliding member 30 with respect to the routed position of the drive wire 15, which is pulled from the wire introduction port 33*a* to the outside of the sliding member 30 and heads for the upper side (guide pulley 18 side). The fixation support portion 47 has a shape projecting to the side portion of the sliding member 30 with respect to the routed position of the drive wire 16, which is pulled from the wire introduction port 34*a* to the outside of the sliding member 30 and heads for the lower side (wire guide member 20 side).

Figure 8:
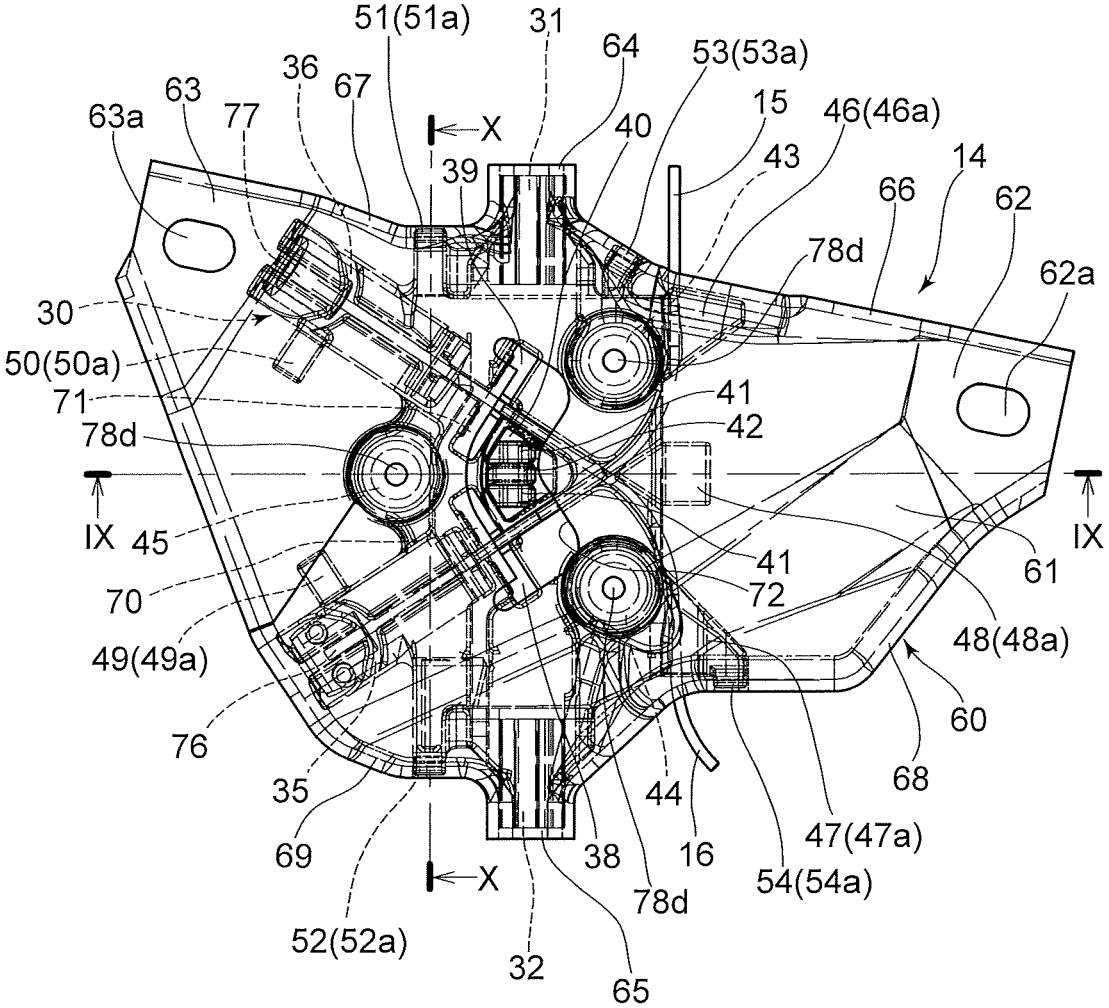
FIG. 8 is a drawing viewing the slider base from the vehicle outer side.

The holder member 60 faces the side where the flanges 66, 67, 68, and 69 and the insertion pieces 70 and 71 project to the vehicle inner side, and the cover 61 is covered over the sliding member 30 from the vehicle outer side to be installed. As illustrated in FIG. 4 and FIG. 8, with the holder member 60 installed to the sliding member 30, the guide shoe 31 and the guide shoe 32 of the sliding member 30 are inserted into the sandwiching portion 64 and the sandwiching portion 65 disposed at the holder member 60. The insertion of the guide shoe 31 into the sandwiching portion 64 changes the free state illustrated in FIG. 11 to the elastic deformation state illustrated in FIG. 4. Specifically, a maximum width from the sidewall 80 to the sidewall 81 of the guide shoe 31 in the free state is larger than the interval between the opposed surfaces of the sidewall 87 and the sidewall 88 of the sandwiching portion 64; therefore, the sidewall 80 and the sidewall 81 where the expansion in the vehicle front-rear direction is restricted by the sidewall 87 and the sidewall 88 are elastically deformed in a state of approaching to one another. At this time, as illustrated in FIG. 4, clearances in the vehicle front-rear direction are present between the formation position of the narrowing portion 86 in the guide shoe 31 and the sidewall 87 and the sidewall 88 of the sandwiching portion 64. Similar to the guide shoe 31, the insertion of the guide shoe 32 into the sandwiching portion 65 sets the guide shoe 32 in the elastic deformation state where the sidewall 80 and the sidewall 81 approach to one another. Clearances in the vehicle front-rear direction are present between the formation position of the narrowing portion 86 in the guide shoe 32 and the sidewall 87 and the sidewall 88 of the sandwiching portion 65.

The installation of the holder member 60 to the sliding member 30 causes the abutting surfaces 48*a*, 49*a*, and 50*a* of the elastic support portions 48, 49, and 50 of the sliding member 30 to abut on the cover 61 of the holder member 60 to be supported. As illustrated in FIG. 9, the elastic support portion 48 elastically deforms toward the vehicle inner side with the abutting surface 48*a* brought into abutment with the cover 61. While not illustrated in FIG. 9, the elastic support portions 49 and 50 are similarly elastically deformed toward the vehicle inner side to cause the abutting surfaces 49*a* and 50*a* to abut on the cover 61.

Figure 10:
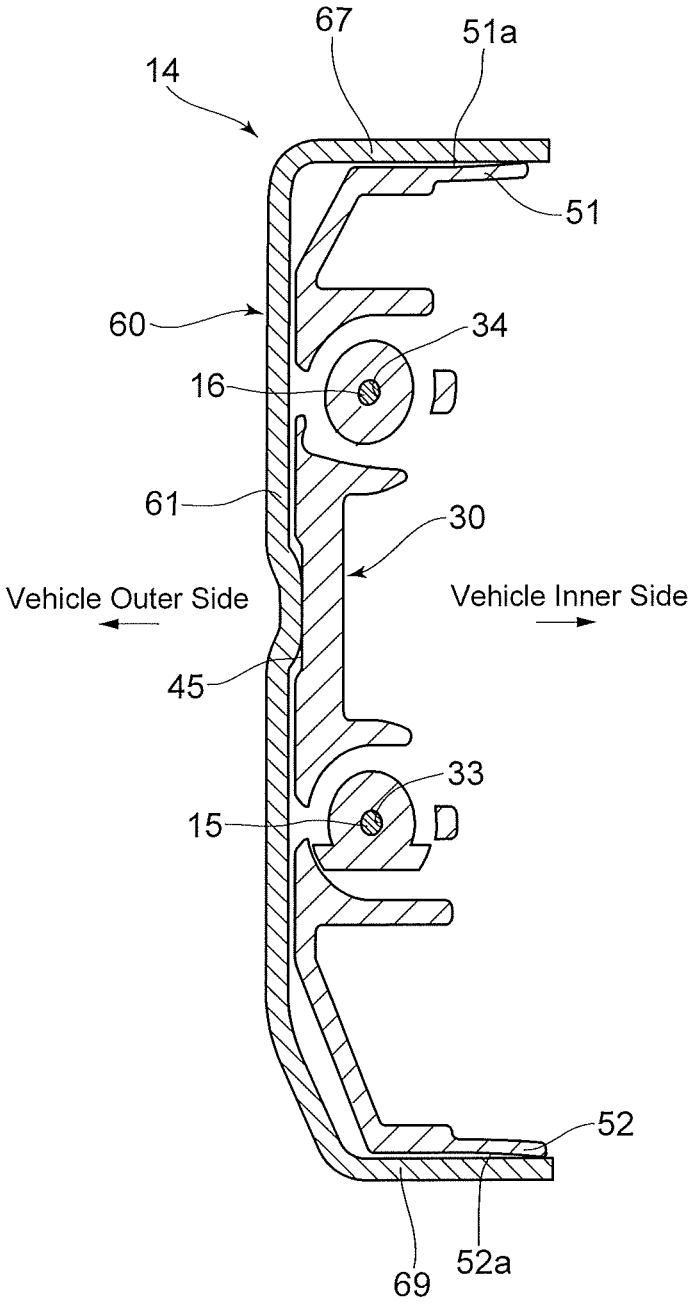
FIG. 10 is a cross-sectional view taken along the line X-X of FIG. 8.

Furthermore, the installation of the holder member 60 to the sliding member 30 causes the abutting surfaces 51*a*, 52*a*, 53*a*, and 54*a* of the elastic support portions 51 and 52, 53, and 54 to abut on the flanges 66, 67, 68, and 69 of the holder member 60, respectively, to be supported (FIG. 8). As illustrated in FIG. 10, the elastic support portion 51 elastically deformed downward causes the abutting surface 51*a* to abut on the flange 67, and the elastic support portion 52 elastically deformed upward causes the abutting surface 52*a* to abut on the flange 69. While not illustrated in FIG. 10, the elastic support portion 53 elastically deformed downward causes the abutting surface 53*a* to abut on the flange 66 similar to the elastic support portion 51, and the elastic support portion 54 elastically deformed upward causes the abutting surface 54*a* to abut on the flange 68 similar to the elastic support portion 52.

The guide shoes 31 and 32 sandwiched by the sandwiching portions 64 and 65 determine the position of the sliding member 30 with respect to the holder member 60 in the vehicle front-rear direction. When the abutting surfaces 48*a*, 49*a*, and 50*a* of the elastic support portions 48, 49, and 50 abut on the cover 61, the position of the sliding member 30 with respect to the holder member 60 in the vehicle inner-outer direction is determined. When the abutting surfaces 51*a*, 52*a*, 53*a*, and 54*a* of the elastic support portions 51 and 52, 53, and 54 abut on the flanges 66, 67, 68, and 69, the position of the sliding member 30 with respect to the holder member 60 in the vehicle up-down direction is determined. By causing the abutting parts on the sliding member 30 side in the elastic deformation state to abut on, variations of accuracy of the components and accuracy of the installation of the sliding member 30 and the holder member 60 can be absorbed at these respective parts.

When the holder member 60 is installed to the sliding member 30, the support surfaces 46*a* and 47*a* of the fixation support portions 46 and 47 of the sliding member 30 are opposed to the cover 61 of the holder member 60, the upper edge of the fixation support portion 46 is opposed to the flange 66, and the lower edge of the fixation support portion 47 is opposed to the flange 68 (FIG. 8). When a load attempting to largely incline the sliding member 30 in the vehicle up-down direction and the vehicle inner-outer direction with respect to the holder member 60 is applied, the fixation support portion 46 and the fixation support portion 47 abut on the opposed parts on the holder member 60 side, thus allowing enduring the load.

When the holder member 60 is installed to the sliding member 30, the insertion piece 70 is inserted into the insertion groove 38, and the insertion piece 71 is inserted into the insertion groove 39. Both of the insertion pieces 70 and 71 have the groove portion at the distal end, the drive wire 15 is inserted into the groove portion of the insertion piece 70 and the drive wire 16 is inserted into the groove portion of the insertion piece 71.

The sliding member 30 and the holder member 60 are fastened with three swaged pins 78. As illustrated in FIG. 9, the swaged pins 78 include heads 78*a*, intermediate diameter portions 78*b*, and small-diameter portions 78*c*. At the respective swaged pins 78, the small-diameter portions 78*c* are inserted into the fastening holes 73, 74, and 75 of the holder member 60, and the intermediate diameter portions

78*b* are inserted into the insertion holes 43*a*, 44*a*, and 45*a* of the sliding member 30. Then, the distal ends of the small-diameter portions 78*c* are swaged to form swaged portions 78*d* with the heads 78*a* brought into abutment on the fastening seats 43, 44, and 45 of the sliding member 30, thus fastening the sliding member 30 and the holder member 60 (see FIG. 9). FIG. 9 illustrates the fastening with the swaged pin 78 at the position of the fastening seat 45 and the fastening hole 75. The fastening with the swaged pins 78 is performed similar to FIG. 9 at the position of the fastening seat 43 and the fastening hole 73 and the position of the fastening seat 44 and the fastening hole 74.

The slider base 14 configured as described above is installed to the guide rail 11. In the slider base 14, the upper and the lower guide shoes 31 and 32 and the pair of vibration suppressing projections 41 and the grease receiving projection 42, which are disposed at the intermediate position, can slidably abut on the guide rail 11. As illustrated in FIG. 4, the guide shoe 31(32) causes the sidewall 11*b* to fit to the thin groove portion 84 and causes the support flange 11*c* to be inserted into the wide width groove portion 85. The sliding surfaces 11*d* and 11*e* of the sidewall 11*b* are sandwiched by the sidewall 80 and the convex portion 83, which constitute both sides of the thin groove portion 84, thus determining the position of the slider base 14 with respect to the guide rail 11 in the vehicle front-rear direction. The wide width groove portion 85 has a size where the support flange 11*c* is inserted in the vehicle inner-outer direction with margin.

As illustrated in FIG. 6 and FIG. 9, with the slider base 14 slidably supported to the guide rail 11, the support flange 11*c* and the sidewall 11*b* of the guide rail 11 are positioned inside the injection space 55 of the grease injection portion 40. In more detail, the sidewall 11*b* and the support flange 11*c* of the guide rail 11 are positioned at the approximately center of the injection space 55 in the vehicle front-rear direction. In the vehicle inner-outer direction, the entire support flange 11*c* is positioned inside the injection space 55, the most part of the sidewall 11*b* is positioned inside the injection space 55, and a part of the sidewall 11*b* projects from the opening 57 to vehicle inner side. The first sliding surface 11*d*-1 of the support flange 11*c* faces the opening 56 side of the injection space 55, and the second sliding surface 11*e*-1 faces the opening 57 side of the injection space 55. The edge surface 11*f* of the guide rail 11 is opposed to the inner surface of the injection space 55 with an interval.

As illustrated in FIG. 4 and FIG. 6, the pair of vibration suppressing projections 41 in the elastic deformation state abut on the first sliding surface 11*d*-1 on the vehicle outer side of the support flange 11*c* in the injection space 55. The support flange 11*c* is positioned inside the wide width groove portion 85 with the second sliding surface 11*e*-1 on the vehicle inner side biased to the convex portion 83 side of the guide shoe 31 (32). Accordingly, the first sliding surface 11*d*-1 and the second sliding surface 11*e*-1 are sandwiched by the convex portion 83 of the guide shoe 31 (32) and the pair of vibration suppressing projections 41, which are disposed at the different positions in the vehicle up-down direction, thus determining the position with respect to the support flange 11*c* in the vehicle inner-outer direction. The slider base 14 can move in the longitudinal direction of the guide rail 11 while sliding the guide shoes 31 and 32 and the pair of vibration suppressing projections 41 with respect to the sidewall 11*b* and the support flange 11*c*.

As illustrated in FIG. 6, with the slider base 14 installed to the guide rail 11, in the grease receiving projection 42 of the slider base 14, an inclined portion 42*a* is positioned opposed to the vehicle inner side of the second sliding surface 11*e*-1 of the support flange 11*c* and the distal end bended portion 42*b* is positioned opposed to the sliding surface 11*e* of the sidewall lib. The inclined portion 42*a* has a predetermined space with the second sliding surface 11*e*-1 of the support flange 11*c* in the vehicle inner-outer direction, and the distal end bended portion 42*b* is positioned adjacent to the sliding surface 11*e* of the sidewall lib.

FIG. 1 and FIG. 2 illustrate a complete state of the window regulator 10 where the routing of the drive wire 15 and the drive wire 16 is completed and the slider base 14 is slidably supported by the guide rail 11. Upon rotating the drive drum 22 in the drum housing 21 in the complete state, one of the drive wire 15 and the drive wire 16 is pulled and the other is loosened according to the rotation direction. The drive wire 15 or 16 being pulled transmits a force to the end surface (the end on the side coupled to the wire guide groove 33 or 34) of the wire end housing portion 35 or 36 via the wire end 76 or 77. The abutment of the wire end 76 or 77 on the end surface of the wire end housing portion 35 or 36 restricts the move (the move to the drive drum 22 side) of the slider base 14 any further. Accordingly, a force of moving the slider base 14 in the longitudinal direction of the guide rail 11 acts from the drive wire 15 or 16 being pulled. The insertion piece 70 is positioned on an extension of an action direction of a load applied from the wire end 76 to the end surface of the wire end housing portion 35 when the drive wire 15 is pulled. The insertion piece 71 is positioned on an extension of an action direction of a load applied from the wire end 77 to the end surface of the wire end housing portion 36 when the drive wire 16 is pulled. Receiving the load in the pulling direction given by the respective drive wires 15 and 16 at the insertion pieces 70 and 71, which are a part of the metallic holder member 60, contributes an improvement in load resistance performance of the slider base 14. The drive wire 15 or 16 being loosened is pushed in a direction of away from the end surface of the wire end 70 or 72 by a force of a spring (not illustrated) disposed inside the wire end housing portion 35 or 36, thus removing looseness. FIG. 1 and FIG. 2 illustrate the state where the slider base 14 is positioned at the lowermost position in the movable range along the longitudinal direction of the guide rail 11.

As illustrated in FIG. 3, with the slider base 14 slidably supported to the guide rail 11, the injection space 55 of the grease injection portion 40 in the sliding member 30 can be visually perceived from the vehicle outer side through the through-hole 72 of the holder member 60. Grease for lubrication is injected to the inside of the injection space 55 of the grease injection portion 40. The grease is injected from the vehicle outer side to the injection space 55 through the through-hole 72 and the opening 56. As described above, the sidewall 11*b* and the support flange 11*c* of the guide rail 11 are positioned at the approximately center in the vehicle front-rear direction inside the injection space 55 (see FIG. 6 and FIG. 9). The grease injected to the injection space 55 of the grease injection portion 40 is accumulated at the peripheral areas of the sidewall 11*b* and the support flange 11*c*.

The pair of vibration suppressing projections 41 and the grease receiving projection 42 are disposed inside the injection space 55. Arrows G1 and G2 of FIG. 6 schematically indicate the flow of the grease along the vibration suppressing projections 41 and the grease receiving projection 42 inside the injection space 55. As illustrated in FIG. 6, the base end of the vibration suppressing projection 41 is connected to a part near the opening 56 on the vehicle outer side of the grease injection portion 40, and the vibration suppressing projection 41 is disposed to extend while being inclined toward the distal end abutting on the sliding surface 11*d* of the support flange 11*c*. Therefore, the grease (G1) flowing along the vibration suppressing projection 41 is accumulated in the space facing the sliding surfaces 11*d* of the support flange 11*c* and the sidewall lib. At the space between the respective vibration suppressing projections 41, the grease injected from the opening 56 is accumulated on the first sliding surface 11*d*-1 of the support flange 11*c*.

As illustrated in FIG. 6, the grease receiving projection 42 has the base end connected to the inner surface of the injection space 55 positioned at the vehicle inner side with respect to the support flange 11*c*. Additionally, while inclined from this base end to the vehicle inner side, the grease receiving projection 42 is disposed to extend up to behind (the position on the vehicle inner side) of the sliding surface 11*e* of the support flange 11*c*. Therefore, the grease (G2) flowing along the grease receiving projection 42 passes through a part between the edge surface 11*f* of the guide rail 11 and the inner surface of the injection space 55, proceeds to the vehicle inner side with respect to the flange 11*c*, and is accumulated in a space (hereinafter referred to as a back side accumulation space) facing the second sliding surface 11*e*-1 of the support flange 11*c* and the sliding surface 11*e* of the sidewall 11*b*. Especially, since the grease receiving projection 42 has the inclined portion 42*a*, the interval between the second sliding surface 11*e*-1 of the support flange 11*c* and the inclined portion 42*a* increases as the back side accumulation space heads for the far-side (the direction of the sidewall 11*b*) and the grease is likely to flow into the back side accumulation space along the inclined portion 42*a*. As illustrated in FIG. 6, the distal end bended portion 42*b* of the grease receiving projection 42 is approximated to the sliding surface 11*e* of the sidewall 11*b*; therefore, the grease is less likely to flow out from the back side accumulation space to the vehicle inner side.

The injection space 55 penetrates the sliding member 30 in the vehicle inner-outer direction. However, as illustrated in FIG. 5, viewed from the vehicle outer side (the opening 56 side), since the pair of vibration suppressing projections 41 and the grease receiving projection 42 occupy the most part of the injection space 55, the grease injected from the vehicle outer side is effectively accumulated to the inside of the injection space 55 and the grease is less likely to leak to the vehicle inner side. Additionally, since the grease receiving projection 42 is positioned between the pair of vibration suppressing projections 41, the grease is likely to flow to the grease receiving projection 42 and the grease is easily supplied to the back side accumulation space efficiently. Furthermore, the pair of vibration suppressing projections 41 and the grease receiving projection 42 are arranged on different positions in the vehicle up-down direction. This facilitates a die-cut when the sliding member 30 is molded. Note that, in FIG. 5, a clearance is provided at the distal end sides (between the distal ends and the intersecting portion 37) of the pair of vibration suppressing projections 41 and the grease receiving projection 42 in the injection space 55. Since this clearance is a region covered from the vehicle inner side by the plate-shaped portion 11*a* of the guide rail 11 when the slider base 14 is installed to the guide rail 11 (FIG. 6 and FIG. 9), the grease does not leak from this clearance to the vehicle inner side.

As described above, the injection of the grease from the one direction (vehicle outer side) to the injection space 55 of the grease injection portion 40 disposed at the slider base 14 surely allows the grease to run through the back side accumulation space (the space on the sides of the second sliding surface 11*e*-1 of the support flange 11*c* and the sliding surface 11*e* of the sidewall lib), which is at the position that cannot be directly visually perceived from the vehicle outer side, in addition to the region along the first sliding surface 11*d*-1 of the support flange 11*c* facing the opening 56 on the injection side and the region along the sliding surface 11*d* of the sidewall 11*b* continuous with the first sliding surface 11*d*-1. When the slider base 14 is moved in the vehicle up-down direction along the guide rail 11 while the grease is injected in the injection space 55 of the grease injection portion 40, the grease inside the injection space 55 is applied over the sliding surfaces (sliding surfaces 11*d* and 11*e* of the sidewall 11*b* and the first and the second sliding surfaces 11*d*-1 and 11*e*-1 of the support flange 11*c*) of the guide rail 11 in association with the move of the slider base 14. This eliminates the need for applying the grease along the guide rail 11 as the elongated member and only needs to inject the grease from the one direction to the injection space 55 of the slider base 14. Accordingly, the work to supply the grease to the sliding part between the guide rail 11 and the slider base 14 becomes significantly easy, improving the productivity.

This also ensures simplifying devices and instruments for grease injection.

The grease receiving projection 42 of the slider base 14 is elastically deformable in the vehicle inner-outer direction. Therefore, when the grease receiving projection 42 abuts on the support flange 11*c* due to a swing of the slider base 14 with respect to the guide rail 11 in the vehicle inner-outer direction and the like, the grease receiving projection 42 appropriately elastically deforms and absorbs the load, thereby ensuring maintaining the smooth sliding of the slider base 14. Further, by guiding the grease to the back side accumulation space (the sides of the sliding surface 11*e* and the second sliding surface 11*e*-1) of the guide rail 11 using the grease receiving projection 42, which is thus elastically deformable and excellent in following capability to the guide rail 11, the grease can be supplied to the sliding part with the guide rail 11 with more certainty.

The grease injection portion 40 is positioned between the guide shoe 31 and the guide shoe 32 in the vehicle up-down direction of the slider base 14. Therefore, extra grease not contributing to an improvement in smoothness of the sliding by the slider base 14 is less likely to remain at parts near the upper end and near the lower end of the guide rail 11 when the slider base 14 reaches the moving end in the vehicle up-down direction, and the grease can be supplied to the sliding part between the guide rail 11 and the slider base 14 without waste.

After the application of the grease, the window glass is pressed from the vehicle outer side against the glass mounting portion 62 and the glass mounting portion 63 of the holder member 60, the bolts for fastening the glass are inserted through the bolt insertion holes 62*a* and 63*a* to fix the window glass. Thus, the slider base 14 is in a state of supporting the window glass.

While the present invention has been described above based on the illustrated embodiment, the present invention is not limited to the illustrated embodiment, and improvements and modifications can be made without departing from the gist of the invention. For example, while the slider base 14 of the window regulator 10 of the embodiment is constituted by the combination of the sliding member 30 made of synthetic resin and the metallic holder member 60, a slider base having a configuration different from the configuration thus combining the plurality of members is usable as an application target of the present invention.

While the window regulator 10 of the embodiment has the configuration of injecting the grease from the opening 56 on the vehicle outer side of the injection space 55, the present invention does not limit the injection direction of the grease in the vehicle inner-outer direction. A configuration to inject the grease from the vehicle inner side is selectable according to the configurations of the guide rail and the slider base.

INDUSTRIAL APPLICABILITY

As details have been described above, the window regulator of the present invention has an effect of ensuring easily and surely supplying the grease to the sliding part of the slider base with respect to both of the first sliding surface and the second sliding surface of the guide rail, thereby ensuring contributing to improvements in productivity and operability of the window regulator.

DESCRIPTION OF REFERENCE SIGNS

10 window regulator
11 guide rail
11*a* plate-shaped portion
11*b* sidewall
11*c* support flange
11*d* sliding surface
11*e* sliding surface
11*d*-1 first sliding surface
11*e*-1 second sliding surface
11*f* edge surface
11*g* projecting portion
12, 13 bracket
14 slider base
15, 16 drive wire
15T, 16T outer tube
17 pulley bracket
18 guide pulley
19 pulley support shaft
20 wire guide member
21 drum housing
22 drive drum
23 motor
30 sliding member
31, 32 guide shoe (guide portion)
33, 34 wire guide groove
33*a*, 34*a* wire introduction port
35, 36 wire end housing portion
37 intersecting portion
38, 39 insertion groove
40 grease injection portion
40 vibration suppressing projection (vibration
41 suppressing portion) grease receiving projection (grease receiving portion)
42*a* inclined portion
42*b* distal end bended portion
43, 44, 45 fastening seat
43*a*, 44*a*, 45*a* insertion hole
46, 47 fixation support portion
46*a*, 47*a* support surface
48, 49, 50, 51, 52, 53, 54 elastic support portion
48*a*, 49*a*, 50*a*, 51*a*, 52*a*, 53*a*, 54*a* abutting surface
55 injection space
56, 57 opening
60 holder member
61 cover
62, 63 glass mounting portion
62*a*, 63*a* bolt insertion hole
64, 65 sandwiching portion
66, 67, 68, 69 flange
70, 71 insertion piece
72 through-hole
73, 74, 75 fastening hole
76, 77 wire end
78 swaged pin
80, 81 sidewall
82 bottom wall
83 convex portion
84 thin groove portion
85 wide width groove portion
86 narrowing portion
87, 88 sidewall
89 bottom wall

The invention claimed is:

1. A window regulator comprising:
a guide rail fixed to a vehicle door panel; and
a slider base that supports a window glass, said slider base being slidably supported in a longitudinal direction of said guide rail, wherein:
said guide rail includes a sliding portion along which said slider base is slidable, said sliding portion including a first sliding surface and a second sliding surface that face one direction and another direction in a vehicle inner-outer direction,
said slider base includes a grease injection portion, and
said grease injection portion includes:
an injection space that opens to the vehicle inner-outer direction, said first sliding surface being positioned inside said injection space; and
a grease receiving portion opposed to said second sliding surface, said grease receiving portion configured to receive a grease injected in said injection space,
wherein said grease receiving portion is an elastically deformable projection projecting from an inner surface of said injection space.

2. A window regulator comprising:
a guide rail fixed to a vehicle door panel; and
a slider base that supports a window glass, said slider base being slidably supported in a longitudinal direction of said guide rail, wherein:
said guide rail includes a sliding portion along which said slider base is slidable, said sliding portion including a first sliding surface and a second sliding surface that face one direction and another direction in a vehicle inner-outer direction,
said slider base includes a grease injection portion, and
said grease injection portion includes:
an injection space that opens to the vehicle inner-outer direction, said first sliding surface being positioned inside said injection space; and
a grease receiving portion opposed to said second sliding surface, said grease receiving portion configured to receive a grease injected in said injection space,
wherein said grease receiving portion has an inclined shape extending in a direction away from said second sliding surface in the vehicle inner-outer direction as said grease receiving portion advances from a base end connected to said inner surface of said injection space to a distal end side.

3. The window regulator according to claim 1, wherein said guide rail has an edge facing a vehicle front-rear direction and connecting said first sliding surface and said second sliding surface, said edge being positioned inside said injection space.

4. The window regulator according to claim 1, wherein:

said slider base includes a pair of guide portions on different positions in the longitudinal direction of said guide rail, said pair of guide portions being slidable with respect to said first sliding surface and said second sliding surface; and said grease injection portion is positioned between said pair of guide portions in the longitudinal direction of said guide rail.

5. A window regulator comprising:

a guide rail fixed to a vehicle door panel; and a slider base that supports a window glass, said slider base being slidably supported in a longitudinal direction of said guide rail, wherein:

said guide rail includes a sliding portion along which said slider base is slidable, said sliding portion including a first sliding surface and a second sliding surface that face one direction and another direction in a vehicle inner-outer direction, said slider base includes a grease injection portion, and said grease injection portion includes:

an injection space that opens to the vehicle inner-outer direction, said first sliding surface being positioned inside said injection space; and a grease receiving portion opposed to said second sliding surface, said grease receiving portion configured to receive a grease injected in said injection space, wherein said injection space internally includes a vibration suppressing portion, said vibration suppressing portion being slidable with respect to said first sliding surface.

6. The window regulator according to claim 5, wherein said grease receiving portion is positioned between a pair of said vibration suppressing portions in the longitudinal direction of said guide rail inside said injection space.

7. A window regulator comprising:

a guide rail fixed to a vehicle door panel; and a slider base that supports a window glass, said slider base being slidably supported in a longitudinal direction of said guide rail, wherein:

said guide rail includes a sliding portion along which said slider base is slidable, said sliding portion including a first sliding surface and a second sliding surface that face one direction and another direction in a vehicle inner-outer direction, said slider base includes a grease injection portion, and said grease injection portion includes:

an injection space that opens to the vehicle inner-outer direction, said first sliding surface being positioned inside said injection space; and a grease receiving portion opposed to said second sliding surface, said grease receiving portion configured to receive a grease injected in said injection space, wherein said grease receiving portion is a projection projecting from an inner surface of said injection space.

* * * * *